US007421752B2

(12) United States Patent
Donadon et al.

(10) Patent No.: US 7,421,752 B2
(45) Date of Patent: Sep. 9, 2008

(54) HOUSEHOLD-TYPE WATER-RECIRCULATING CLOTHES WASHING MACHINE WITH AUTOMATIC MEASURE OF THE WASHLOAD TYPE, AND OPERATING METHOD THEREOF

(75) Inventors: Andrea Donadon, Porcia (IT); Silvano Cimetta, Treviso (IT); Marco Giovagnoni, Udine (IT); Fabio Altinier, Porcia (IT); Mirko Gasparini, Spilimbergo (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 207 days.

(21) Appl. No.: 11/423,484

(22) Filed: Jun. 12, 2006

(65) Prior Publication Data

US 2006/0283214 A1 Dec. 21, 2006

(30) Foreign Application Priority Data

Jun. 16, 2005 (EP) ..... 05105293

(51) Int. Cl.
*D06F 35/00* (2006.01)

(52) U.S. Cl. ..... 8/158

(58) Field of Classification Search ..... 8/158
See application file for complete search history.

(56) References Cited

U.S. PATENT DOCUMENTS 6,023,950 A * 2/2000 Battistella ..... 68/12.04
6,634,191 B1 * 10/2003 Guler et al. ..... 68/12.04
2003/0041390 A1 * 3/2003 Kim et al. ..... 8/158
2005/0125909 A1 * 6/2005 Bellinetto et al. ..... 8/158
2006/0107468 A1 * 5/2006 Urbanet et al. ..... 8/158

FOREIGN PATENT DOCUMENTS

| | | |
|---|---|---|
| EP | 1 350 881 | 10/2003 |
| GB | 2 051 413 | 1/1981 |
| GB | 2 076 648 | 12/1981 |

* cited by examiner

*Primary Examiner*—Frankie L. Stinson
*Assistant Examiner*—Samuel A Waldbaum
(74) *Attorney, Agent, or Firm*—Pearne & Gordon LLP

(57) ABSTRACT

Household-type front loading and water-recirculating clothes washing machine adapted to automatically measure the nature of the dry clothes loaded in the machine for washing, in which the measurement of such weight of the washload is performed by measuring the amount of water that is absorbed by the clothes in the washload when this is soaked with water to a point at which it is in a dynamic saturation, i.e. steady-state condition. Said measurement of the amount of water absorbed in the clothes is obtained by subtracting the amount of water that is present in the machine, and that does not interact with the washload, from the total amount of water let into the wash tub. The nature of the load of clothes is finally calculated by processing and interpolating the amount of water that is released by said load with respect to the water previously absorbed, and comparing said data with corresponding data relevant to reference textiles, whose nature is known.

7 Claims, 2 Drawing Sheets

HOUSEHOLD-TYPE WATER-RECIRCULATING CLOTHES WASHING MACHINE WITH AUTOMATIC MEASURE OF THE WASHLOAD TYPE, AND OPERATING METHOD THEREOF

The present invention refers to a working method of an improved kind of clothes washing machine generally described in the first pages of the European Pat. Application n. EP 04106014.6 of the same applicant, able of carrying out a method to automatically check the type (nature) of the washload through the measuring of its water absorption values under pre-defined and known conditions.

Said machine is provided with a wash tub, inside which there is arranged and capable of rotating a clothes-holding drum having a substantially horizontal rotation shaft, said washing machine being further provided with means for recirculating the wash liquor and is adapted to optimise the general performance capabilities thereof, i.e. to each time perform a washing programme that enables the best possible results to be achieved under minimization of the usage data of the various process factors employed, i.e. water, washing products and electric power, along with the time needed to complete the washing programme selected.

It is here reminded that all parameters of the washing process, i.e. the washing time and the number of rinses, the temperature, the mechanical action, and so on, must be closely correlated with each other in order to be able to define an optimized washing program, what however has to be selected according to the two "commanding" washload features, i.e.

the amount of clothes to be washed, that is the load weight, and the qualitative characteristics of said washload, that is its attitude of absorbing more or less water.

As a matter of fact, a good knowledge of the washload, both in the quantity and in the quality, is practically a kind of pre-condition to be fulfilled in view of being able to set a washing programme and cause the washing machine to operate in such a manner as to ensure optimum washing results under minimization of the machine operating requirements in terms of water, washing product and energy usage, as well as time needed to complete the washing process.

The problem of the determination of the washload weight has been already solved by the cited European patent application; the instant patent application regards and solves the problem of the determination of the qualitative features of the washload, automatically performed by the washing machine; such an information, once combined with the information on the washload weight, will allow to define a washing programme which is here referred as an "universal" programme, not in the meaning that it is a fixed or pre-defined programme to be used in any given washload, but a program which as a preliminary operation starts with the measuring of both the washload type and weight, and therefore it automatically adaptes to the features of the same washload, without any further user input.

The advantage or the need of the knowledge of the washload features is well known: please check the patents GB 2 076 648, GB 2 051 413 and also EP 1350881A1 which have been cited by said EP 04106014.6, that has moreover discussed respective their drawbacks, that for sake of conciseness are here again not discussed.

The need of be informed on the washload weight is specifically claimed in the cited EP 04106014.6 at page 19, point 14), rows 27 to 29:

"The so obtained result is rectified on the basis of the information entered by the user concerning the type of fabrics in the washload (specific water absorption properties so as to obtain . . . . "

See also the block 19 in the relevant FIG. 2.

It would therefore be desirable, and is actually a main object of the present invention to provide:

1) a washing method in a front-loading clothes washing machine provided with an arrangement to circulate the washing liquor, which is adapted to automatically measure the washload introduced in the drum on the basis of information to be entered by the user and concerning the type and, therefore, the properties of the clothes in the washload, as well as on the basis of an information on the amount of water absorbed by such washload under pre-established conditions, by processing such data and even by performing interpolations with previously determined experimental data duly stored in the clothes washing machine itself.

2) a washing method able to select the most suitable washing programme based on the water absoption properties, and then to generate the information on the washing load weight and type, which can be used in a combined manner by the same machine in order to automatically implement the washing cycle.

In addition, the methods of the above-noted kind shall be easily implemented using existing, readily available techniques; it shall further be competitively simple in its construction and convenient to use. In particular, it shall be capable of being implemented with only minor modifications to current washing machine designs. Moreover, the features added in accordance with the present invention shall by no means affect the reliability level of the washing machine itself.

According to the present invention, these aims as set forth above are reached in a measurement and working method to be carried out in a kind of clothes washing machine that is provided with such operating and control means as described below by way of non-limiting example with reference to the accompanying drawings, in which.

Figure 1:
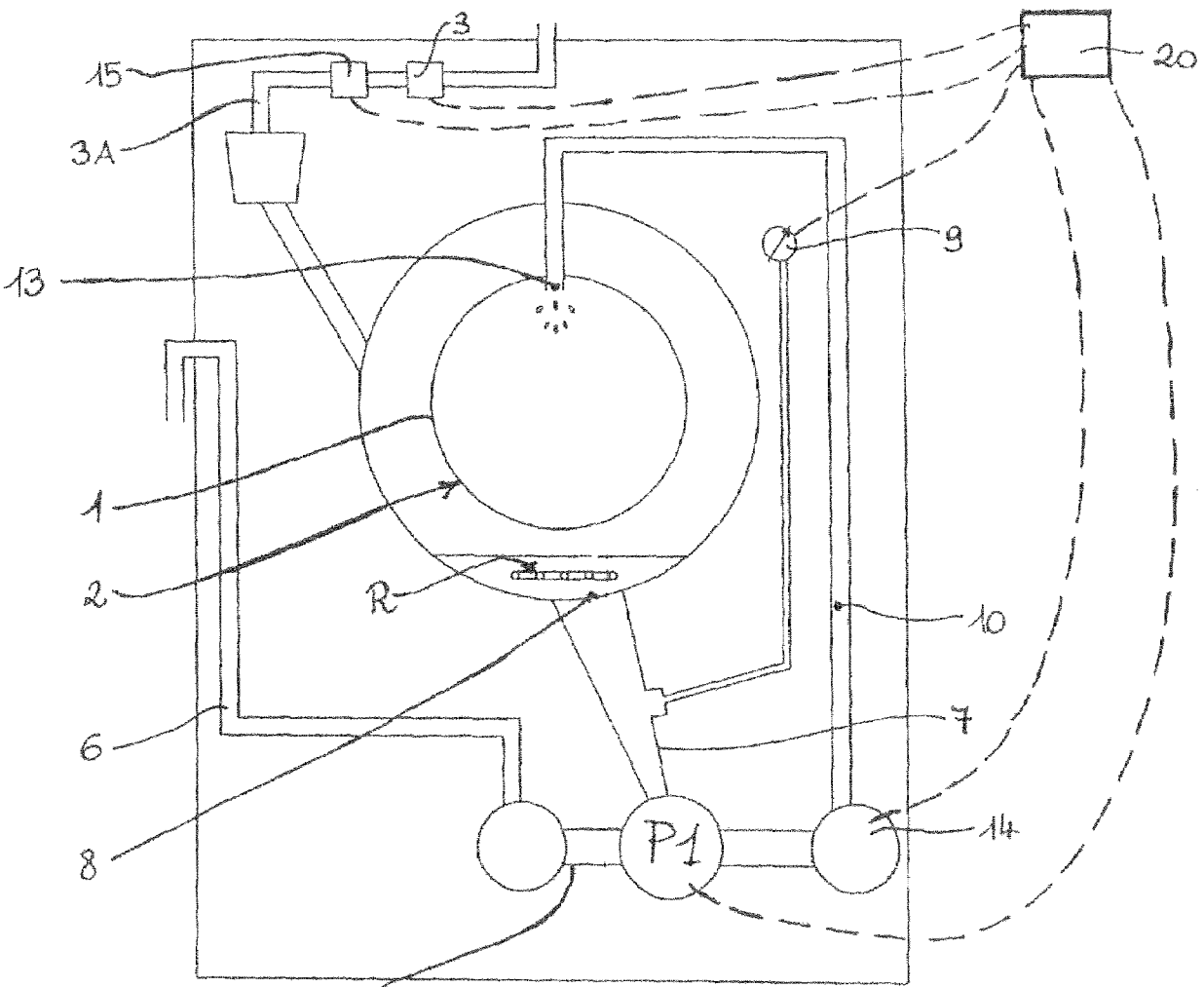
FIG. 1 is a symbolical view of the structure of the functional devices and parts relevant to the method of present invention in a clothes washing machine of the household type.
Figure 2:
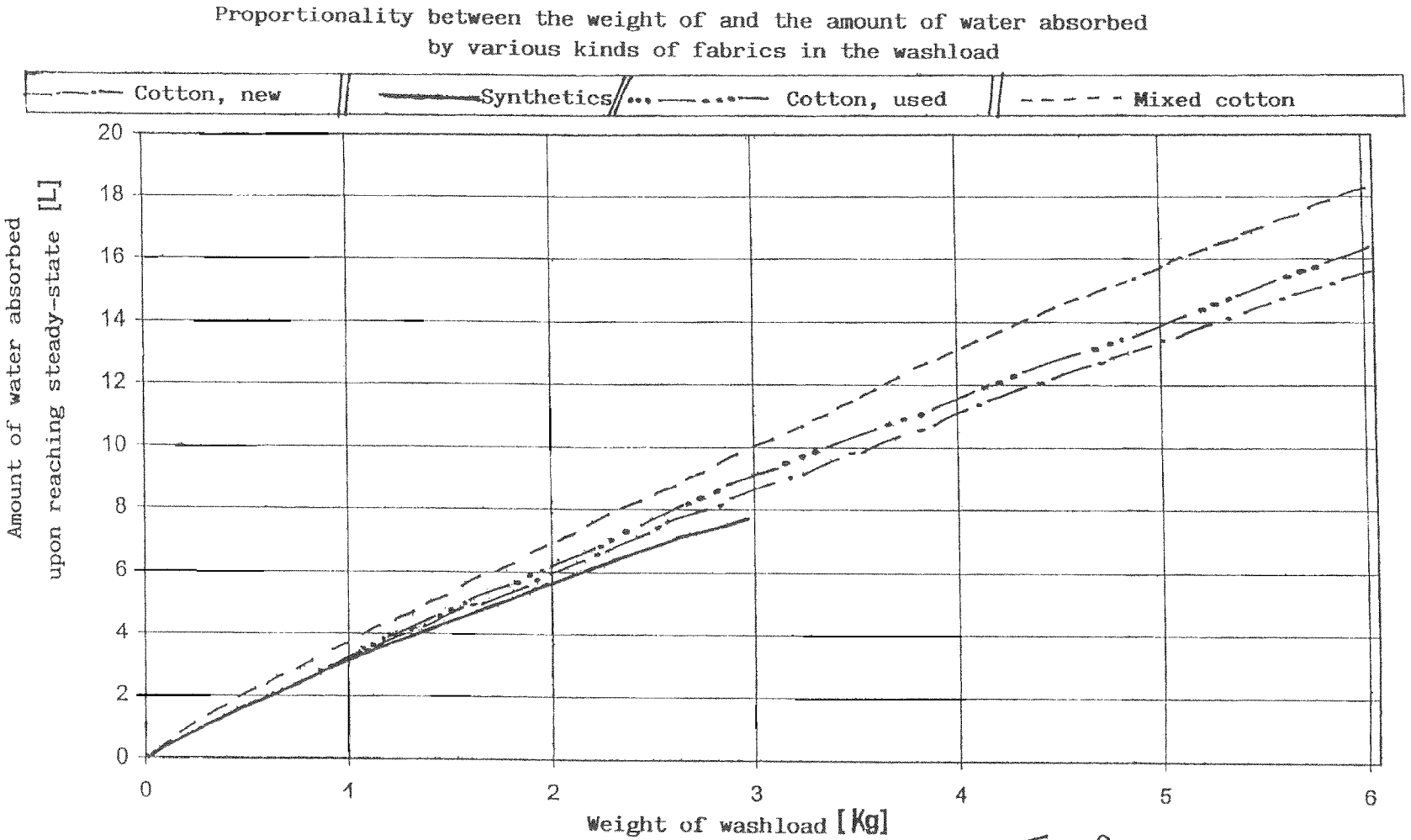
FIG. 2 is a diagrammatical view showing the relations existing between the weight of a given washload and the amount of water absorbed by such washload for different types of textile material used in the clothes forming said washload.

The methodological approach, which the present invention is substantially based upon, is the following one.

The method according to the present invention applies for instance to a clothes washing machine that comprises a perforated drum 1 rotatably arranged inside a sealed tub 2; a device for letting water from the water supply line into said tub comprises an electromagnetic valve 3 and a conduit 3A connecting said electromagnetic valve with said tub.

Below the tub there is provided a drain manifold 4 connected with the outlet pipe 6 on one side and the sleeve 7 on the opposite intake side, the other end of said sleeve 7 being in turn connected with an opening 8 provided in the bottom of said tub.

In an appropriate position along said sleeve 7 there is further provided a tap for a pressure switch 9 to be connected to.

Since the present invention applies to a clothes washing machine provided with a feature for re-circulating the washing liquor into the drum, there is suitably provided a so-called re-circulation manifold 10 connected via a conduit 11 to known means 13, such as an appropriate nozzle, adapted to direct a jet of water into said drum. Although such nozzle 13 is illustrated as being seemingly arranged inside the drum, other solutions are however possible, in which said means 13 is for example situated on the upper side of the loading door gasket and the water jet issuing therefrom enters the drum and hits the clothes directly, without passing first through the perforations in the walls of the same drum.

Also said re-circulation manifold 10 is provided with an appropriate pump 14 adapted to take in the liquor from the drain manifold and pump it towards said means 13, from which the liquor is then sprayed into the drum.

On the conduit that carries the water from the water supply line, or on said conduit 13A, there is fitted a device 15, which measures the amount of water that is let into the machine on the whole; such device can for instance be a flowmeter of any standard type, or the like, which is associated to processing means adapted to integrate the signal generated by it with the time.

Furthermore, said clothes washing machine is provided with control means 20, connected to said flowmeter and the other operating or functional parts of the machine, wherein said control means are also adapted to receive the start command entered by the user. In addition, said control means are adapted to also receive a command that is representative of the various types and kinds of fabrics that may be included in a washload.

In a clothes washing machine having a drum rotating about a substantially horizontal axis, the amount of water that is absorbed by a single washload at any particular instant is a function of a number of factors, among which the most important ones are:

- the amount of clothes in the washload (weight of washload),
- the type of clothes, i.e. fabrics in the washload, in connection with the aptitude thereof to absorb water,
- some other factors, including:
  - the rotating speed of the drum,
  - the water level in the wash tub or extent to which the washload is submerged in the water,
  - the temperature of the water being filled into the tub,
  - other factors of a geometrical and mechanical nature relating to the particular construction of the machine.

It is well known in the art that the nature of the fiber composing the washing load significantly affects the water amount that can be absorbed; however, to remind the matter to the interested reader, the FIG. 1 shows how the amount of the water absorbed by a certain washload depends, further on the wash load weight, also on the type of the respective textiles.

Particularly said figure shows that the amount of the absorbed water depends in a substantially proportional way on the load weight; the absorbed water depends also on the following conditions, apart the specific physical nature of the fiber under consideration:

- the water temperature,
- the condition of the same fiber (compressed, extended . . . )
- the degree of the fiber soaking, (i.e., if the fiber is fully saturated with water, or not, and in this case how much water can be still be absorbed)
- and possible other conditions,
- It was also observed a phenomenon that is the basis of the instant invention: after have been fully soaked, if said washload is left resting under pre-defined and controlled conditions, it releases a water amount, previously contained in it, that is proportional to the water amount originally retained by that load, and this fact is easily understandable, but which is also not independent of the type, or nature, of the textile under test; as a matter of facts, the quantity of water released is strictly depending on the quantity of the originally retained water under pre-defined conditions, according to the following relationship:

$$A_1 = k \cdot A_0,$$

wherein:—$A_1$ is the water quantity released by a washload which had previously absorbed a total water quantity equal to $A_0$, k is a constant depending on the textile nature.

Therefore it turns out that if pre-defined test conditions are accomplished, relevant to the measurement of said values of $A_1$ and $A_0$, then the ratio $A_1/A_0$, gives a value that without doubts identifies the nature of the textile under test.

Then it is advisable to a realize some pre-defined test conditions, and to measure the value of k relevant to a number of types of textiles, in order to find out the relationship between a specific value of k and a respective nature of that textile, or fiber, as per the following exemplary TABLE: (the k values are arbitrary ones)

K=0.10 . . . WOOLLENS
K=0.25 . . . COTTON
K=0.35 . . . SYNTETICS
K=0.15 . . . SPONGE
K=0.5 . . . CORDAGE
and so on.

Such feature of the textile behaviour, in water retaining/releasing, is used to set up those process conditions in the washing machine and for the actual washload, that are equivalent to the test conditions selected in order to measure the corresponding absorbtion and releasing values, and therefore to compute the relevant k, for the same type of fabric.

When the $A_1/A_0$ ratio is detected for an item to be washed, then it will be very easy to compare that ratio with the k values given in the following TABLE, which shows the relationship between a plurality of k values previously stored, associated to respective textile natures; said comparison allows the immediate identification of the nature of the actual item to be washed.

In order to use a method which is logical and consistent, the effect of further factors, as the drum rotating speed, the water temperature and the machine geometric and mechanical features, have to be duly taken into account.

All these factors are kept at a definite, constant value both during the preliminary experiments carried out to measure the correlation of the various factors with each other, and during the measurement of the amount of water that is absorbed and the released by the washload under examination.

In this way, the effect of said factors is duly and automatically incorporated in both the determination of the relations existing between said factors and the measurement of the amount of absorbed water. Since these factors are not subject to any modification, their effect on the comparison of the measured data with each other is obviously nil, in the sense that if the amount of released water is found to change, this can only mean that such change is solely ascribable to a change intervened in the nature of the washload under examination since, owing to said other factors being constant, the effect thereof on said change can only be nil.

As far as the level of the water being present in the wash tub is concerned, it should in this connection be noticed, and most clearly stated, that the present invention applies to clothes washing machines that enable the clothes in the washload to be soaked by a jet generated by an appropriate water circulation circuit and a pump associated thereto, which hits the clothes from, for example, a site situated close to the front loading door of the machine, without any need for the water provided for such washing process to actually flow into the drum, and reach the clothes contained therein, by rising from the bottom portion of the tub.

Such circumstance has a twofold advantage: in the first place, the water usage is drastically reduced, owing to reasons that are well-known to and, in any case, most readily understood by all those skilled in the art, so that they shall not be explained here any further.

In the second place, since the tub is not filled with water, but simply collects from the bottom the water that falls thereonto from the drum that is sprayed by said jet throwing water thereinto, this water is conveyed into the sleeve 7, as this shall be explained in greater detail further on. In practice, the tub operates with just a very small amount of water in it, wherein the level of this water lies in any case below the lower edge of the drum Sometimes, and solely for mere reasons of safety, such level of the water may be allowed to lie above the level at which the heating elements are situated.

In practice, this means that the variable relating to the water level in the drum is eliminated, and this reduces the number of the factors that need being considered, with the ultimate result of an improved correlation between the amount of absorbed water and the amount of clothes loaded in the drum.

At this point, the need anyway arises for another method-related aspect to be cleared up: in order to carry out all these measurements and comparisons, it is of course necessary for standard and constant conditions to be defined, under which said measurements are to be made.

Since the amount of water absorbed by the clothes in a washload depends also on the length of time during which the water is allowed to be in contact with said clothes, the measurements are assumed to be carried out in a precisely defined condition, that can be repeated, i.e. when the water absorption reaches a dynamic balance, i.e. steady-state condition, which means that the amount of water being absorbed is equal to the amount of water being released by the fibres under examination in the same time length.

It is here assumed that the procedure to generate the condition of dynamic balance for water soaking be the same procedure as defined in the cited EP 04106014.6, that here is not repeated for sake of brevity and simiplicity.

Once that the absorbed water amount has been recognized in condition of dynamic balance, as explained in points 1) to 13) of the method as described in said EP 04106014.6, the following steps are performed, which by consistency are numbered from 14 on.

14) The machine is completely stopped, i.e. the drum rotation and the ricirculation pump are stopped, and the valve 3 is being closed; from this time on the sole dynamic phenomenon into the machine is the releasing, by gravity, of a part of the water contained and retained by the laundry load; said water percolates throught the drum holes and falls down on the tub bottom, and from there obviously enters said manifold 10.

15) After a pre-determined time period, or when pre-defined conditions take place, the water level is again measured and, by knowing the shape and the volume of the portion of the hydraulic circuit below the drum, tub included, the total amount of the released water is computed.

It is useful here to precise that the level measurement can take place under different conditions; of course the simplest one is after a predetermined time length has elapsed, which must be long enough to allow a water release that is of appreciable amount in order not to compromise the measurement precision, but also not too long in order not to penalize the washing cycle overall length; it was observed that an optimum compromise of said release time, after that the level measurement has to be done, is about 1 min.

However it is possible that the release time be measured when some pre-established conditions are met, for instance when the amount of released water tents to stabilize, i.e. when its increase in successive time intervals tents to progressively reduce; such a procedure is more complex and yet may be used without problems, as further procedures able to check the amount of the released water, provided each procedure be exactly the same used to determine the various k coefficient, as previously explained.

16) Once the $A_1/A_0$ ratio has been computed, the problem of the identification of the washload nature is solved, since it will suffice to compare such ratio, just detected, to the closest k value previously stored, and to select the corresponding type of washload.

17) At this point the method for the identification of the washload nature is concluded; should one now wish to set the "universal" programme, previously defined, it will enough to send the just detected identification on the washload type, into further methods aimed to the washload evaluation, as the method for the measurement of the washload weight, for example as divulged in said EP 04106014.6, which exactly needs the information of the washload nature to indicate the corresponding washload weight.

17A) As an alternative to step 17, the method may go on with the straight selection of the corresponding washing programme, without any intermediate step to measure the washload weight; such alternative method may be activated when, for instance, the information on the washload weight is being directly set by the user, or, more simply, when the user decides to set a washing programmes that are intended for general purpose or for "standard" washloads.

The ways of programming the most adequate washing cycle, based on the washload weight and type, are well known in the art, and therefore will not be further explained.

From this moment on, the programme goes on with its sequence of operations in an easily imaginable manner that has no relevance as far as the present invention is concerned, actually.

It can at this point be more readily appreciated that the above-described method can be most perfectly implemented in a clothes washing machine of a generally known kind, and operating based on the wash-liquor re-circulation principle, without any modification or adaptation being required as far as the hardware is concerned, as long as the control unit 20 of the machine is duly provided and set with an appropriate operation programme including also the information and data that have been previously found experimentally in that same type of washing machine.

The instant invention may be advantageously improved by the following embodiment: in the facts it may happen that, if the amount of the released water is large enough, its level may reach and go over the lower edge of the drum, so submerging that portion of the laundry washload staying below that level; this condition obviously deteriorates the measurement precision; such a drawback may be easily overcome if the level measurement is properly corrected, taking into account two effects which are acting in opposite ways, i.e.:

the first effect wherein the washload portion, which is immersed, doesn't release water any more, and then the mesured actual water level is lower than the level which would be measured if no immersion of the washload had taken place;

a second effect wherein the water amount, that is released, fills only that tub portion that is outside the drum, since the inner drum portion is already taken by the immersed washload; therefore the measured level is higher than the level which would be measured if the whole inner volume of the tub were available.

The invention claimed is:

1. Method in a clothes washing machine provided with a wash tub, inside which there is arranged and is capable of rotating a washload-holding drum having a substantially horizontal or inclined axis of rotation, said machine being further provided with means for re-circulating the wash liquor, characterized in that it comprises following steps, in which:

prior to starting a washing cycle, an amount of water is absorbed by a washload until a pre-defined condition is reached, before the water level reaches the lower edge of the drum, calculation of the amount of the water absorbed by said washload is said condition, based on the difference between the total amount of water let into the machine and the amount of water present in both the tub and in the water-carrying circuits of the machine, waiting step for a pre-determined release period, defined as that time length when the washload releases a portion of the water previously absorbed, measurement of said water amount that has been released in said waiting step, determination of the ratio ($A_1/A_0$) between the water amount that has been released, and the water amount that had been absorbed, comparison between said ratio and a data base, containing previously stored data in the machine, wherein each of said stored data corresponds to a definite type of washload.

2. Method according to claim 1, characterized in that said predetermined release period consists in a fixed time length.

3. Method according to claim 1, characterized in that said predetermined release period consists in the reach of the stabilization of water release under previously defined conditions.

4. Method according to claim 1, characterized in that in that said calculation of the amount of water absorbed by said washload is obtained comprises the following steps:

prior to starting a washing cycle, an amount of water is let into the machine up to a pre-set level in said tub, or up to a known volume of water being filled in the machine;

the water having so been let into the machine is taken in continuously from the bottom of said tub, where it collects when filled in, and re-circulated to be sprayed into the drum, preferably onto the clothes to be washed contained therein;

the drum starts to continuously rotate at a low speed with alternate rotation cycles in the two directions of rotation;

the height of the water on the bottom of the tub is detected and the related information is sent to the control means of the machine;

said level of the water on the bottom of the tub is checked in a substantially continuous manner for it to be lower than a pre-set level and, if this condition is found to be true, a sequence of water refillings and water supply interruptions in the machine are carried out, in which each water refilling is triggered upon reaching a predetermined level that is previously defined solely on the basis of the time elapsed from the end of the previous water refilling and the beginning of the current one, after which the water level is again checked in the same way as at the beginning of this step, if the water level, when checked as per above, is not found to be lower than a pre-set value, then the elapsed time is checked for it to be longer than a pre-determined time and, if this conditions proves to be true, a verification is made to establish whether a dynamic steady-state or balance condition has been reached in the water absorption pattern of the clothes, wherein said condition is defined in a conventional manner, as soon as such steady-state water absorption condition is found to have been reached, the level of the water present on the bottom of the tub is detected and the amount of water present in both the tub and the water-carrying circuits of the machine is calculated automatically;

the so calculated amount of water is then subtracted from the total amount of water having been filled in the machine, thereby obtaining the net amount of water absorbed by the clothes in the washload.

5. Method according to claim 4, characterized in that said measurement of the total amount of water released by the washload, during said waiting step, is implemented by measuring the water level into the tub, and said measurement is then properly corrected due to the presence and shape of the drum when the same water level reaches and exceeds the drum lower edge.

6. Method according to claim 4, characterized in that said information on the washload nature is properly coded, and the relevant coded data are processed and used in order to automatically select a respective washing cycle.

7. Method according to claim 4, characterized in that said information on the washload nature is properly coded, and the relevant coded data are processed and used to identify the washload weight.

* * * * *